United States Patent [19]

Maehara

[11] 4,144,792

[45] Mar. 20, 1979

[54] PIANO PLATE

[75] Inventor: Kazuo Maehara, Hamamatsu, Japan

[73] Assignee: Nippon Gakki Seizo Kabushiki Kaisha, Japan

[21] Appl. No.: 774,698

[22] Filed: Mar. 4, 1977

[30] Foreign Application Priority Data

Mar. 11, 1976 [JP] Japan ..... 51-25624

[51] Int. Cl.[2] ..... G10C 3/08

[52] U.S. Cl. ..... 84/188

[58] Field of Search ..... 84/184, 185, 186, 187, 84/188, 189, 190, 192

[56] References Cited

U.S. PATENT DOCUMENTS

| | | | |
|---|---|---|---|
| 1,703,168 | 2/1929 | Powers | 84/184 |
| 2,570,102 | 10/1951 | Crippen, Sr. | 84/189 |
| 3,191,293 | 6/1965 | Wickham | 84/188 |
| 3,472,112 | 10/1969 | Taguchi et al. | 84/192 |
| 3,562,027 | 2/1971 | Takamura et al. | 84/187 |

FOREIGN PATENT DOCUMENTS

| | | | |
|---|---|---|---|
| 2710505 | 9/1977 | Fed. Rep. of Germany | 84/188 |

*Primary Examiner*—L. T. Hix
*Assistant Examiner*—Benjamin R. Fuller
*Attorney, Agent, or Firm*—Ostrolenk, Faber, Gerb & Soffen

[57] ABSTRACT

A piano plate is provided, preferably on the top surface thereof, with a fine rugged pattern comprised of a number of shallow recesses of various shapes and dimensions for betterment of its resonance characteristics responding to vibrations of a wide variety of frequencies, particularly to vibrations in the treble range, and, when required, for enrichment of aesthetic effect. The vacuum process is advantageously used for manufacturing thereof thanks to its smooth flow of molten metal at casting and easy removal of the cast product from the associated mold.

12 Claims, 9 Drawing Figures

PIANO PLATE

BACKGROUND OF THE INVENTION

The present invention relates to an improved piano plate, and more particularly relates to a piano plate provided with an improved surface construction which enhances the acoustic and, when required aesthetic effects of a piano.

For the purpose of improving the tonal quality of pianos, various experiments and tests have been conducted and it has been found that the piano plate, which constitutes a supporting structure along with the wooden framework, carrying the soundboard and strings, plays an important role in the improvement of piano tones. From this point of view, it may be concluded that the conventional piano plate is provided with a substantially smooth surface construction and that this smoothness in the surface renders the piano plate responsive or resonant to sound waves of given frequencies only, i.e. to tonal vibrations generated only some of the strings of the piano, and that such resonance of the piano plate to only sound waves of limited frequencies lowers the acoustic characteristics of a piano of which the piano plate forms a part. It has also been found that the conventional piano plate is very poor in its resonance characteristics responding to tonal vibrations in the treble range.

In the case of grand-type pianos, the top or outer board of the piano is left open when the piano is played to enhance the resonance of the generated tones. As a result, the inside piano plate is exposed to the audience. Because the piano plate is exposed, it is aestheically preferable to apply an ornamental design to the exposed surface portion of the piano plate.

OBJECTS OF THE INVENTION

It is the primary object of the present invention to provide a piano plate which is highly responsive to tonal vibrations of wide variety of frequencies.

It is another object of the present invention to provide a piano plate which is particularly responsive to tonal vibrations in the treble range.

It is the other object of the present invention to provide a piano plate assuring a rich aesthetic effect.

SUMMARY OF THE INVENTION

In accordance with the present invention, the piano plate is provided with a fine rugged pattern formed preferably in the top surface thereof, the pattern being comprised of a number of shallow recesses of various shapes and dimensions. In a preferable embodiment, the rugged pattern is an ornamental design.

More particularly, the present invention is directed toward an improved piano plate comprising:

- a plate portion;
- a plurality of beams coupled to said plate portion;
- means formed in said plate portion for receiving string supporting pins; and
- said plate portion having an outer surface, said outer surface having a plurality of fine recesses formed therein, said recesses each having a predetermined shape and being distributed along a predetermined pattern.

DETAILED DESCRIPTION OF THE INVENTION

Figure 1:
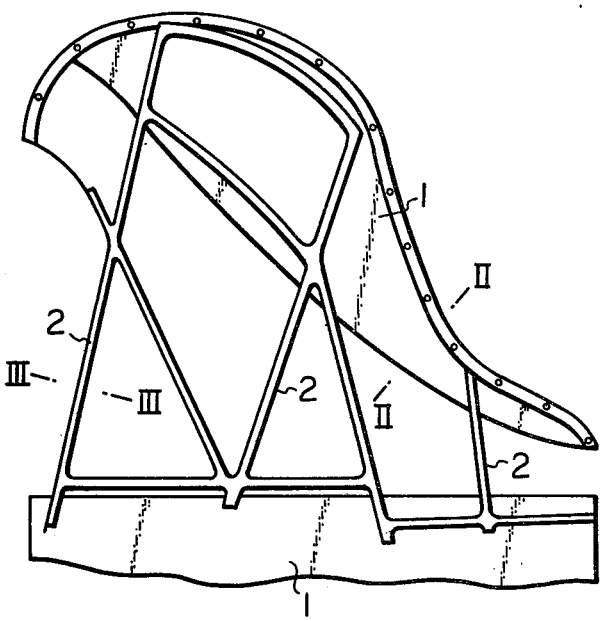
FIG. 1 is a top view of a piano plate for a grand type piano to which the present invention is applied.

A piano plate for a grand-type piano is shown in FIG. 1, in which the piano plate is comprised of x plate portions 1 and a number of beams 2 coupled to the plate portions 1. Although the present invention is most advantageously applied to the plate portions 1 of the piano plate, application to the beams 2 also assures an appreciable improvement in the resonance of the piano plate. Needless to say, the present invention can well be applied to piano plates for upright type pianos with similar advantageous effect.

Figure 2:
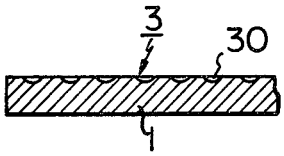
FIG. 2 is a section taken along the line II—II in FIG. 1 of one embodiment of the present invention.
Figure 3:
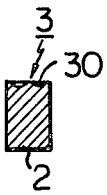
FIG. 3 is a section taken along the line III—III in FIG. 1.

In the arrangement shown in FIG. 2, the present invention is embodied on the plate portion 1 whereas same is embodied on the beam 2 in the arrangement shown in FIG. 3. In both cases, the top or outer surface of the objective, i.e. the plate portion 1 or the beam 2, is provided with a relatively fine, rugged pattern 3 comprised of a number of relatively shallow fine recesses 30 spaced from each other at selected intervals.

Figure 4:
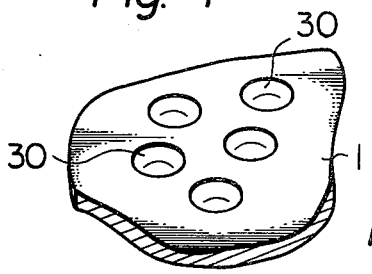
FIG. 4 is a fragmentary perspective view of examplary recesses forming the rugged pattern in the surface of a piano plate in accordance with the present invention.
Figure 5:
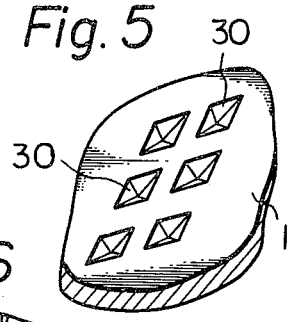
FIG. 5 is a fragmentary perspective view of another example of recesses forming the rugged pattern in the surface of the piano plate in accordance with the present invention.

One example of the recess 30 is shown in FIG. 4, in which the recess 30 is substantially of a semispherical shape whereas the example of the recess 30 shown in FIG. 5 is substantially of a pyramid shape. The recess 30 may be frust-semi-spherical or frust-pyramid shape or of another shape modified from these shapes.

Figure 6:
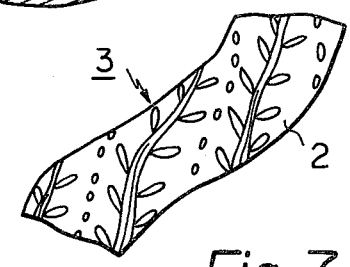
FIG. 6 is a fragmentary perspective view of still another example of recesses forming the rugged pattern in the surface of the piano plate in accordance with the present invention.

In the embodiment shown in FIG. 6, a rugged pattern 3 of a fine ornamental design is formed in the top surface of the beam 2 which provides, in addition to the betterment in the resonance, the piano plate with enriched ornamental beauty.

Although the rugged patterns 3 shown in FIGS. 4 and 5 are comprised of a number of spot recesses 30, same may include, in accordance with requirement for resonance of the piano plate, elongated recesses 30 such as shallow and relatively thin grooves. It should be understood that the rugged pattern 3 in accordance with the present invention may be made up of either a series of repeated recesses 30 of similar type or a mixture of recesses of different types. In the former case, the dimension of each recess 30, e.g. the depth of the recess 30, may vary. In a preferred example, the optimum depth of the recess is in a range from 1 to 2 mm.

at the deepest point when the thickness of the objective, e.g. the plate portion is in a range from 7 to 8 mm.

Shape, dimension, distribution and combination of the recesses should be selected in accordance with acoustic and aesthetic effects expected for the piano plate to which the present invention is to be applied. In general, formation of the rugged pattern in the plate portion 1 serves to improve the acoustic effect of the piano plate whereas formation of the rugged pattern in the beams enriches the aesthetic effect of the piano plate.

For manufacturing of piano plates provided with the rugged pattern in accordance with the present invention, the so-called vacuum casting process is advantageously employed, in which vacuum sealed molds are used for casting. Indeed, it is rather difficult for the conventional green-sand mold casting process to successfully cast piano plates provided with fine rugged patterns in the surfaces thereof without the danger of mold breakage, poor flow of molten metal in the cavity at casting and difficulty in removal of cast products from their associated molds. Covering of the cavity wall synthetic resin films in the vacuum casting assures smooth flow of molten metal in the cavity at casting and easy removal of cast products from their associated molds. Thus, the vacuum molding process is advantageously adapted for production of piano plates provided with fine rugged patterns in their surfaces. Of course, other methods may be employed for the formation of the rugged pattern in the surface of the piano plate. One of such methods is the engrave the surface after the plate is cast.

The presence of the fine rugged pattern in the surface of a piano plate provides the piano plate with a complicated construction as a resonator and the piano plate can possess increased and broadened resonance ranges, thereby ideally responding to tonal vibrations of various frequencies. In other words, resonance of the piano plate can fairly cover overall tones from the bass through treble ranges, which corresponds to all keys of the piano employing the piano plate. There is no bias in the resonance of the piano plate to vibrations of various frequencies.

When a rugged pattern of an ornamental design is formed by the vacuum casting process, the surface of the cast product is by far smoother than that of the product by the conventional green-sand mold casting process. Thus, it is no more necessary to cover the surface of the product with thick painting. The depth of the recess in the cast product can be designed substantially equal to that of the recess in the end product after painting.

The above-described advantageous features will be fairly supported by the numerical data obtained as a result of the following example which is illustrative of the present invention but is not construed as limiting the same.

EXAMPLE

Figure 7:
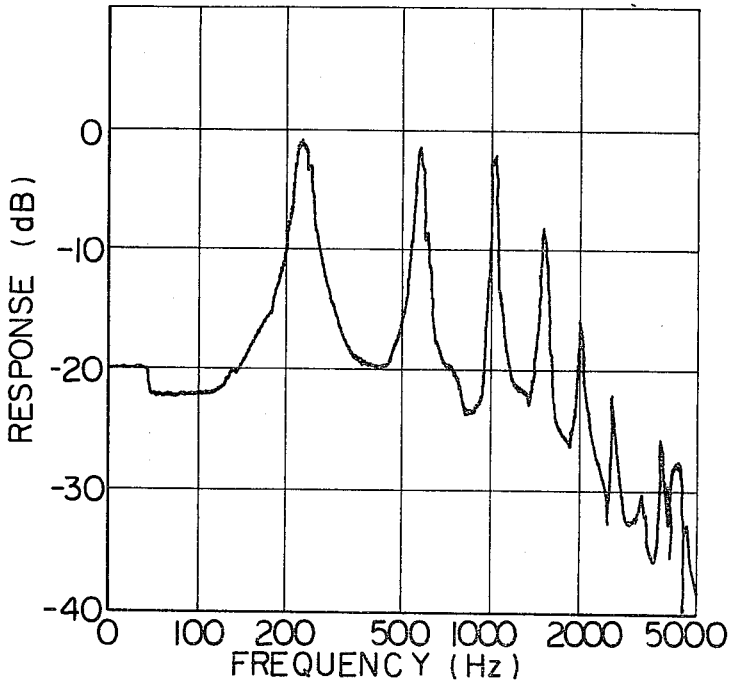
FIG. 7 is a graph for showing the relationship between the vibrational frequency and the response of the conventional piano plate.
Figure 8:
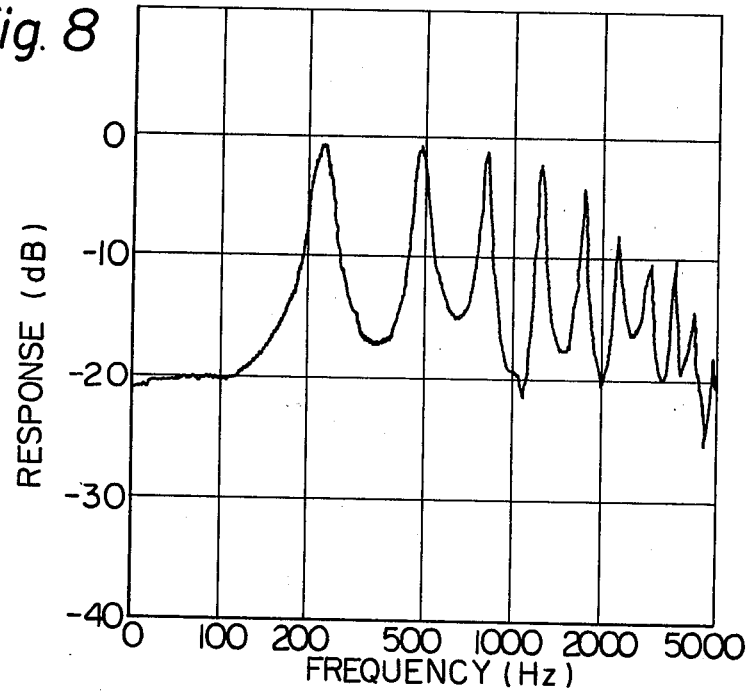
FIGS. 8 and 9 are graphs for showing the relationships between the vibrational frequency and the responses of the piano plates in accordance with the present invention.
Figure 9:
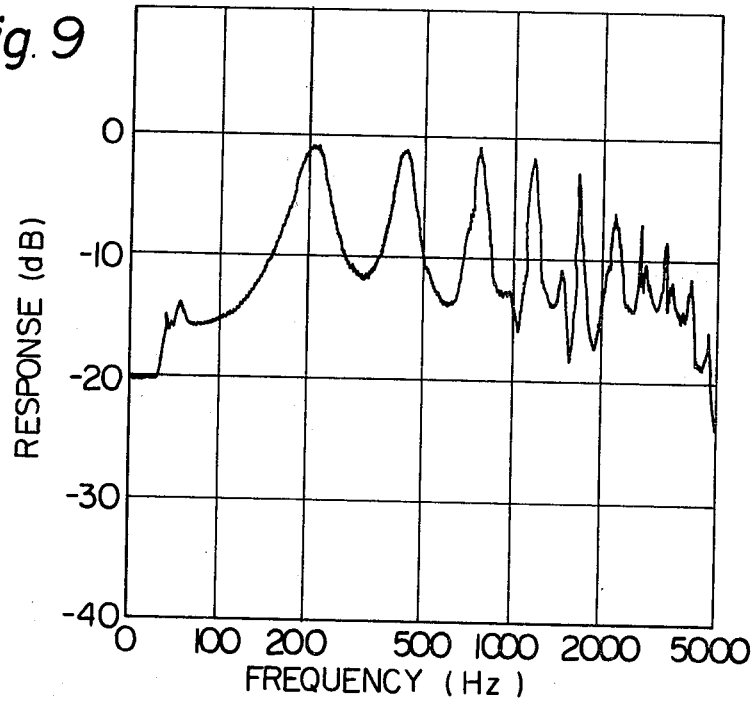

Cast metal test pieces of 5 mm thickness, 30 mm. width and 300 mm. length were prepared. The first piece was cut from the conventional piano plate provided with a flat surface, the second peice embodying the present invention was provided with five semi-spherical shallow recesses formed in the top surface thereof at equal intervals from each other and the third piece also embodying the present invention was provided with ten semi-spherical shallow recesses formed in the top surface thereof at equal intervals. The diameter of the recess was 10mm. and the maximum depth thereof was 2 mm. Response of the test pieces to tonal vibrations of various frequencies was measured and the result for the first piece is shown in FIG. 7, that for the second piece in FIG. 8 and that for the third piece in FIG. 9.

From these graphical representations, it will be well understood that employment of the present invention greatly improves the response of the piano plate to vibrations especially in the treble range. The greater the number of the recess formed in the surface of the piano plate, the better the response of the piano plate to vibrations of overall frequencies. In the case of the piano plate of the present invention, the peaks of the Frequency-Response curve in the higher frequency range are at near even level with respect to those in the other frequency ranges. This means that the resonance characteristics in the higher frequency range are improved and the resultant tones of the higher range becomes satisfactory. Further, the shapes of the curves for the piano plates in accordance with the present invention are by far less sharp than that of the curve for the conventional piano plate. In other words, the piano plate in accordarue with the present invention accords excellent and even response to vibrations of overall frequencies.

I claim:

1. An improved piano plate comprising;
a plate portion;
a plurality of beams coupled to said plate portion;
means formed in said plate portion for receiving string supporting pins; and
said plate portion having an outer surface, said outer surface having a plurality of fine recesses formed therein, said recesses each having a predetermined shape and being distributed along a predetermined pattern.

2. The piano plate of claim 1, wherein the depth of each of said recesses is in the range of 1–2 mm at its deepest point.

3. The piano plate of claim 1, wherein each of said beams has an outer surface, said outer surface of said beams having a plurality of fine recesses formed therein, said fine recesses having a predetermined shape and distributed along a predetermined pattern.

4. The piano plate of claim 1, wherein at least some of said recesses is substantially semi-spherical in shape.

5. The piano plate of claim 1, wherein at least some of said recesses are substantially of a frust-semi-spherical shape.

6. The improved plate of claim 1, wherein at least some of said recesses are substantially of a pyramid shape.

7. The improved piano plate of claim 1, wherein at least some of said recesses are substantially of a frust-pyramid shape.

8. The piano plate of claim 1, wherein at least some of said recesses are elongated.

9. The piano plate of claim 1, wherein each of said recesses has the same shape.

10. The piano plate of claim 1, wherein a first plurality of said recesses have a first shape and a second plurality of said recesses have a second shape.

11. The piano plate of claim 1, wherein said predetermined piano defines an ornamental design.

12. A combination comprising:
(A) a piano plate including:
(1) a plate portion;

(2) a plurality of beams coupled to said plate portion;

(3) said plate portion having an outer surface, said outer surface having a plurality of fine recesses formed therein, said recesses each having a predetermined shape and being distributed along a predetermined pattern;

(B) string support means coupled to said plate portion for supporting a plurality of piano strings in a tensed state; and (C) a sounding board coupled to said piano plate.

* * * * *